US007956539B2

(12) United States Patent
Kim

(10) Patent No.: US 7,956,539 B2
(45) Date of Patent: Jun. 7, 2011

(54) PLASMA DISPLAY PANEL

(75) Inventor: Chul-Hong Kim, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 551 days.

(21) Appl. No.: 11/973,816

(22) Filed: Oct. 9, 2007

(65) Prior Publication Data

US 2008/0084162 A1 Apr. 10, 2008

(30) Foreign Application Priority Data

Oct. 10, 2006 (KR) ..... 10-2006-0098635

(51) Int. Cl.
*H01J 17/49* (2006.01)

(52) U.S. Cl. ..... 313/582; 313/587; 313/583

(58) Field of Classification Search ..... 313/582–587
See application file for complete search history.

(56) References Cited

U.S. PATENT DOCUMENTS 5,977,708 A * 11/1999 Amatsu et al. ..... 313/586
6,923,703 B2 * 8/2005 Furukawa ..... 313/582
2002/0024302 A1 * 2/2002 Wu et al. ..... 313/582
2005/0049350 A1 * 3/2005 Tonapi et al. ..... 524/492
2005/0242725 A1 * 11/2005 Hasegawa et al. ..... 313/582

FOREIGN PATENT DOCUMENTS

JP 2000090840 A * 3/2000
JP 2001015042 A * 1/2001
JP 2006-049917 2/2006
KR 1020050110947 A 11/2005

* cited by examiner

*Primary Examiner* — Mariceli Santiago
(74) *Attorney, Agent, or Firm* — Knobbe Martens Olson & Bear LLP

(57) ABSTRACT

Provided is a plasma display panel including a plurality of electrodes and a panel terminal unit providing a driving signal to the electrodes, wherein the panel terminal unit comprises: an electrode pad extending from the electrodes of the panel display unit; a film-shapeddevice providing a driving signal to the electrode pad; an anisotropic conductive film electrically connecting the electrode pad to the film-shaped device; a dielectric layer extending to contact the anisotropic conductive film on the electrode pad so that the dielectric layer covers the electrode pad; and an electrode terminal unit sealant sealing the dielectric layer and the film-shaped device. The electrode terminal unit sealant protects a terminal unit of the plasma display panel against permeation of external gas and external humidity and effectively prevents open and short circuits of an electrode due to a migration phenomenon.

13 Claims, 5 Drawing Sheets

PLASMA DISPLAY PANEL

CROSS-REFERENCE TO RELATED PATENT APPLICATIONS

This application claims the benefit of Korean Patent Application No. 10-2006-0098635, filed on Oct. 10, 2006, in the Korean Intellectual Property Office, the disclosure of which is incorporated herein in its entirety by reference.

BACKGROUND OF THE INVENTION

1. Field of the Invention

The present embodiments relate to a plasma display panel, and more particularly, to a plasma display panel that effectively prevents an open circuit and a short circuit.

2. Description of the Related Art

Plasma display panels are flat display panels which display images through a gas discharge, and can be formed in thin, large screens having wide viewing angles and high definition.

FIG. 1 is a view of a plasma display panel. Referring to FIG. 1, the plasma display panel includes a front panel 210 which includes a plurality of sustain electrodes, each of which consists of a pair of electrodes including a scan electrode 212 and a sustain electrode 213, disposed on a front surface glass 211 displaying images, and a rear panel 260 which includes a plurality of address electrodes 262 disposed perpendicular to the sustain electrodes on a rear surface glass 261, e.g., a rear surface of the plasma display panel. The front panel 210 is connected and parallel to the rear panel 260 at a predetermined distance.

The front panel 210 includes the scan electrode 212 and the sustain electrode 213 so that a gas discharge occurs and is maintained in a single cell. More specifically, the front panel 210 includes a pair of electrodes including the scan electrode 213 and the sustain electrode 213 respectively including transparent electrodes (212*a*, 213*a*) formed of a transparent ITO material and bus electrodes (212*b*, 213*b*) formed of metal. The scan electrode 212 and the sustain electrode 213 limit discharge current and are covered by an upper dielectric layer 214 that insulates pairs of electrodes from each other. A protective layer 215 is formed on the upper dielectric layer 214 by depositing MgO to facilitate discharge conditions.

In the rear panel 260, barrier ribs 264*b* are disposed parallel to each other to form a plurality of discharge spaces, e.g., discharge cells. The address electrodes 262, which perform an address discharge to generate vacuum ultraviolet rays, are disposed parallel to the barrier ribs 264*b*. R (red), G (green), and B (blue) phosphors 265, which emit visible light to display images during an address discharge, are coated on an upper surface of the rear panel 260. A lower dielectric layer 263 for protecting the address electrodes 262 is formed between the address electrodes 262 and the R, G, and B phosphors 265.

The plasma display panel further includes a frame on which scan, sustain, and address driving units are installed, and a terminal unit that is disposed on the rear surface and provides a predetermined signal transmitted from each driving unit to the plasma display panel.

When the plasma display panel is manufactured, electrodes are typically formed of photosensitive Ag through a printing-drying-exposing-developing-sintering processes. Ag is generally used because it is inexpensive compared to other precious metals and has high electric conductivity. However, Ag leads to very active diffusion and migration, and thus open and short circuits of electrodes can occur.

To prevent such vertical line defects, an ultra violet hardening resin, such as an epoxy acrylate-based resin, can be coated to seal a terminal unit, various organic materials present in the terminal unit can be removed by washing the terminal unit with water before performing a disposing process, or a silane-based material can be coated. However, even in these cases, permeation of external gas and external humidity in the plasma display panel cannot be completely prevented and furthermore, a short circuit or an open circuit due to a migration phenomenon can still occur. The present embodiments overcome the above-mentioned drawbacks and provide these an other advantages over the prior art.

SUMMARY OF THE INVENTION

The present embodiments provide a plasma display panel which effectively prevents an open circuit and short circuit of an electrode.

According to an aspect of the present embodiments, there is provided a plasma display panel including a panel display unit including a plurality of electrodes and a panel terminal unit providing a driving signal to the electrodes, wherein the panel terminal unit includes: an electrode pad extending from the electrodes of the panel display unit; a film-shaped device providing a driving signal to the electrode pad; an anisotropic conductive film electrically connecting the electrode pad to the film-shaped device; a dielectric layer extending to contact the anisotropic conductive film on the electrode pad so that the dielectric layer covers the electrode pad; and an electrode terminal unit sealant sealing the dielectric layer and the film-shaped device.

According to another aspect of the present embodiments, there is provided a plasma display panel including a panel display unit including a plurality of bus electrodes and a panel terminal unit providing a driving signal to the bus electrodes, wherein the panel terminal unit includes: a bus electrode pad extending from the bus electrodes of the panel display unit; a film-shaped device providing a driving signal to the bus electrode pad; an anisotropic conductive film electrically connecting the bus electrode pad to the film-shaped device; an upper dielectric layer extending to contact the anisotropic conductive film on the bus electrode pad so that the upper dielectric layer covers the bus electrode pad; and a bus electrode terminal unit sealant sealing the upper dielectric layer and the film-shaped device.

According to another aspect of the present embodiments, there is provided a plasma display panel including a panel display unit including a plurality of address electrodes and a panel terminal unit providing a driving signal to the address electrodes, wherein the panel terminal unit includes: an address electrode pad extending from the address electrodes of the panel display unit; a film-shaped device providing a driving signal to the bus electrode pad; an anisotropic conductive film electrically connecting the address electrode pad to the film-shaped device; a lower dielectric layer extending to contact the anisotropic conductive film on the address electrode pad so that the lower dielectric layer covers the address electrode pad; and an address electrode terminal unit sealant sealing the lower dielectric layer and the film-shaped device.

According to the present embodiments, permeation of an external gas and external humidity in the plasma display panel can be effectively blocked and short and open circuits of an electrode due to a migration phenomenon can be prevented.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

The present embodiments will now be described more fully with reference to the accompanying drawings, in which exemplary embodiments are shown.

A plasma display panel according to one embodiment includes a panel display unit including a plurality of electrodes and a panel terminal unit providing a driving signal to the electrodes. The panel terminal unit includes an electrode pad extending to the electrodes of the panel display unit; a film-shaped device providing the driving signal to the electrode pad; an anisotropic conductive film which electrically connects the electrode pad to the film-shaped device; a dielectric layer which extends to contact the anisotropic conductive film on the electrode pad so that the dielectric layer covers the electrode pad; and an electrode terminal unit sealant which seals the dielectric layer and the film-shaped device.

In some embodiments, the dielectric layer can be formed of a leadless material, such as ZnO or $Bi_2O_3$.

In some embodiments, an end of the dielectric layer may contact the end of the anisotropic conductive film.

In some embodiments, the electrode can be a discharge electrode.

The electrode terminal unit sealant may contain at least one compound selected from the group consisting of a sulfur-resistant material that can capture sulfur, a silane-based material, titanate-based catalyst, and a migration-resistant compound containing a triazole group.

The sulfur-resistant material may be at least one metal selected from the group consisting of Si, Ti, Al, Fe, Cr, a compound containing these metals and a mixture thereof.

Figure 2:
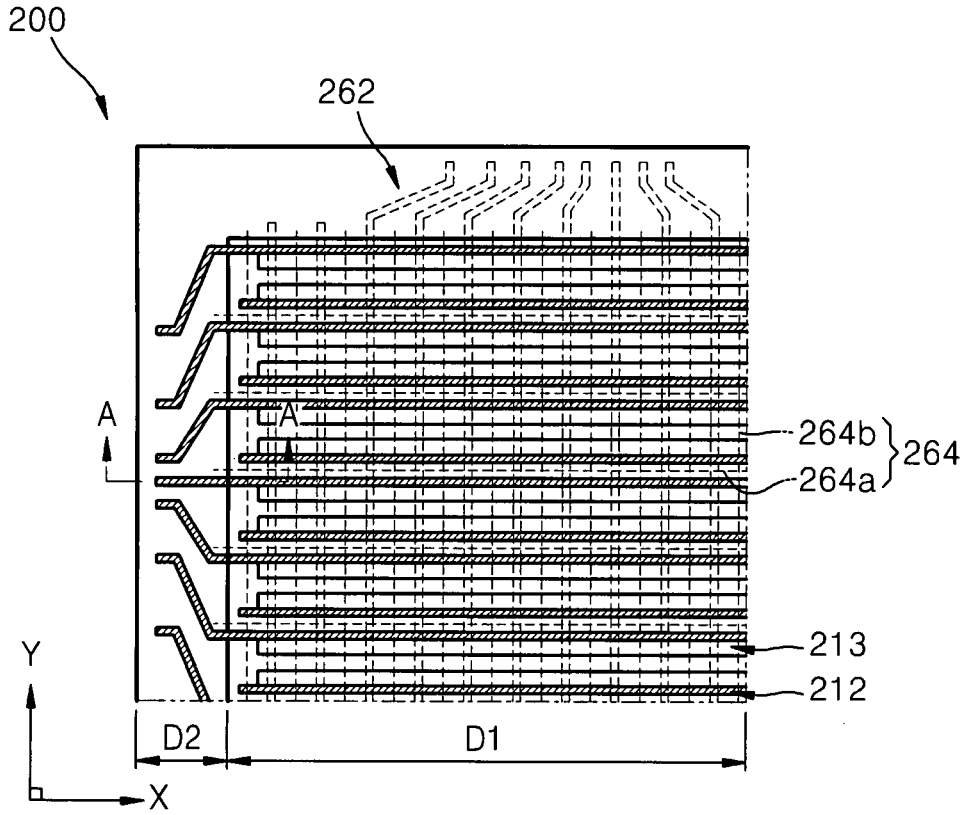
FIG. 2 is an exploded plan view of a conventional plasma display panel.
Figure 3:
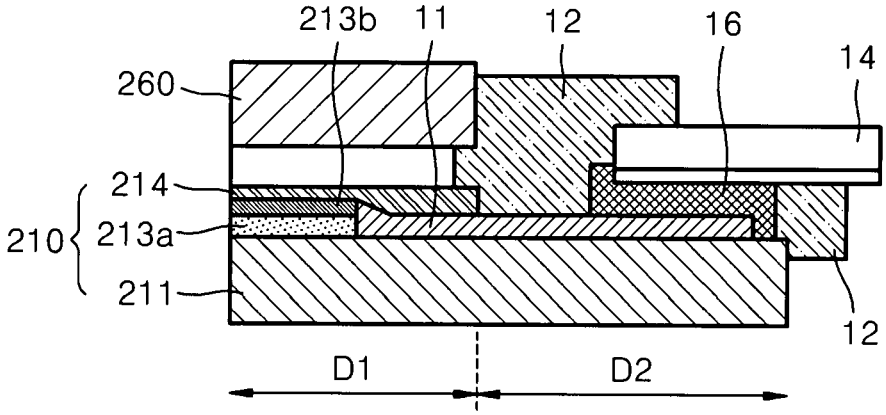
FIG. 3 is a sectional view of the conventional plasma display panel of FIG. 2 taken along line A-A'.

FIG. 2 is an exploded plan view of a plasma display panel, and FIG. 3 is a sectional view of the plasma display panel of FIG. 2 taken along line A-A'. Referring to FIG. 2 and FIG. 3, the plasma display panel includes a panel display unit D1, that is, a plasma display panel, and a panel terminal unit D2.

Figure 1:
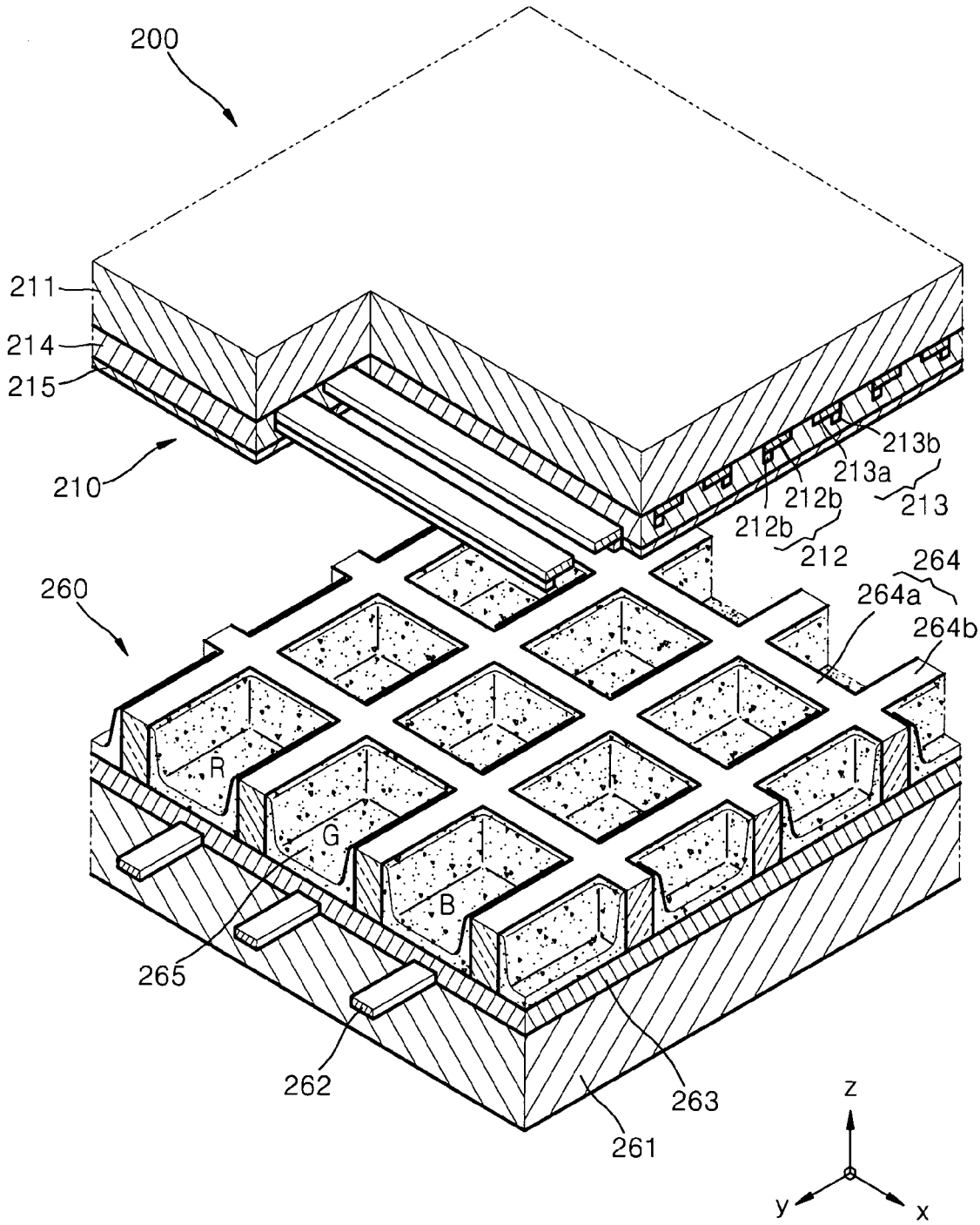
FIG. 1 is a view of a conventional plasma display panel.

The panel display unit D1 has the same structure as described with reference to FIG. 1. That is, the panel display unit D1 includes a front panel 210, a rear panel 260, and a sealant 12 which seals the front panel 210 and the rear panel 260 to form discharge cells. The front panel 210 includes transparent electrodes 212*a* and 213*a* and metal bus electrodes 212*b* and 213*b* formed on edges of the transparent electrodes 212*a* and 213*a*, the transparent electrodes 212*a* and 213*a* acting as scan electrodes or sustain electrodes and being disposed parallel to each other on a front surface glass 211, a metal bus electrode pad 11 extending from the metal bus electrodes 212*b* and 213*b* to the panel terminal unit D2, and an upper dielectric layer 214 and a protective layer 215 which cover the transparent electrode 212*a* and 213*a*, the metal bus electrode 212*b* and 213*b*, and the metal bus electrode pad 11 and are sequentially deposited on the front surface glass 211. The rear panel 260 includes address electrodes 262 disposed perpendicular to the scan electrodes or the sustain electrodes on a rear surface glass 261, and a lower dielectric layer 263 covering the address electrodes 262 on the rear surface glass (not shown).

The panel terminal unit D2 includes the metal bus electrode pad 11 extending from the panel display unit D1 on the front surface glass 211, and a film-shaped device 14 which is connected to the metal bus electrode pad 11 to provide a driving signal controlled by a printed circuit board (PCB) (not shown). The metal bus electrode pad 11 is bonded to the film-shaped device 14 by an anisotropic conductive film (ACF) 16. The ACF 16 can be formed of a film in which conductive particles, such as a metal-coated epoxy or metal particles, are dispersed. The ACF 16 electrically connects the metal bus electrode 212*b* and 213*b* to the film-shaped device 14.

In some plasma display panels, electrodes are typically formed of photosensitive Ag through a printing-drying-exposing-developing-sintering processes. Ag is used because it is relatively inexpensive compared to other precious metals and has high electric conductivity. However, the use of Ag leads to active diffusion and migration and thus, electrodes are frequently open or short circuited.

Figure 4:
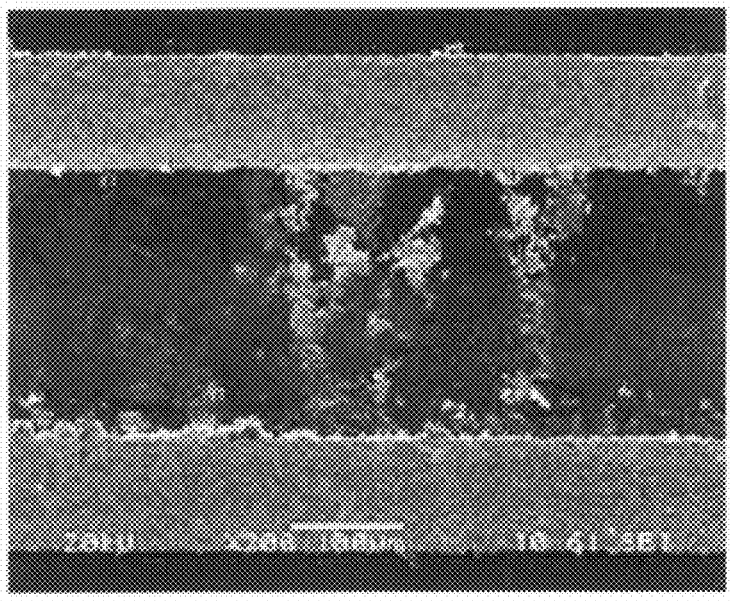
FIG. 4 is an image illustrating a short circuit occurring as a result of a diffusion phenomenon between electrodes due to migration of Ag.
Figure 5:
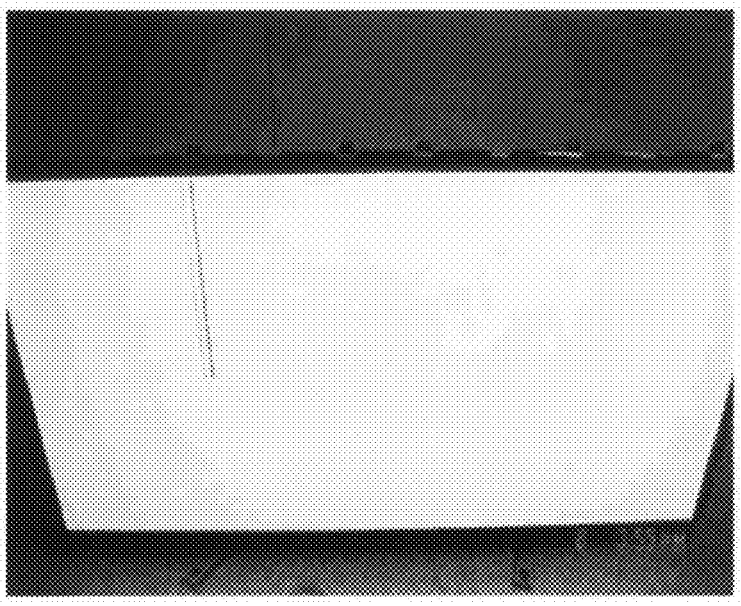
FIG. 5 is an image illustrating a vertical line defect of a plasma display panel.

FIG. 4 is an image illustrating a short circuit occurring as a result of a diffusion phenomenon between electrodes due to migration of Ag. Such a short circuit causes a vertical line defect, that is, formation of a vertical line (see FIG. 5) that cannot be repaired and thus a plasma display panel having a vertical line defect must be discarded.

Figure 6:
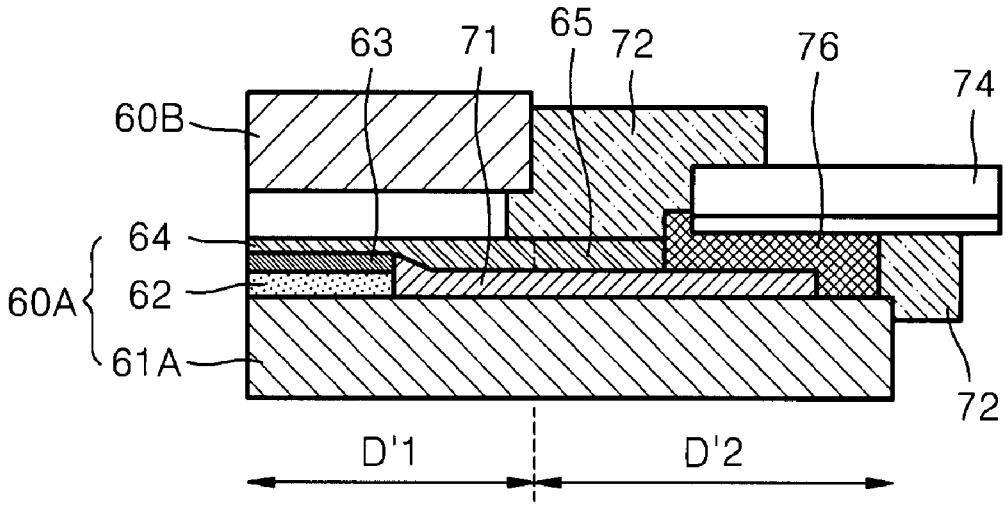
FIG. 6 is a sectional view of part of a plasma display panel according to an embodiment.

FIG. 6 is a sectional view of part of a plasma display panel according to some embodiments.

Referring to FIG. 6, the plasma display panel includes a plasma display unit D'1 displaying images and including a plurality of electrodes and a panel terminal unit D'2 providing a driving signal to electrodes of the panel display unit D'1.

Like a conventional plasma display panel, the panel display unit D'1 includes a front panel 60A, a rear panel 60B, and a sealant 72 which seals the front panel 60A and the rear panel 60B to form discharge cells.

The front panel 60A includes a transparent electrode 62 and a metal bus electrode 63, wherein the metal bus electrode 63 is disposed on an edge of the transparent electrode 62, and the transparent electrode 62 and the metal bus electrode 63 act as scan electrodes or sustain electrodes and are disposed parallel to each other on a front glass 61 A, a metal bus electrode pad 71 extending from the metal bus electrode 63 to the panel terminal unit D'2, and an upper dielectric layer 64 which cover the transparent electrode 62, the metal bus electrode pad 63, and the metal bus electrode pad 71 and are sequentially deposited on the front surface glass 61A and a protective layer (not shown).

Since the upper dielectric layer 64 covers the metal bus electrode 63 and the metal electrode pad 71, the terminal unit can be protected against permeation of external gas or external humidity and open and short circuits of electrodes due to a migration phenomenon can be effectively prevented.

The rear panel 60B includes address electrodes X (not shown) disposed perpendicular to the scan electrodes or the sustain electrodes on a rear surface glass (not shown), and a lower dielectric layer (not shown) covering the address electrodes X which is deposited on the rear surface glass (not shown).

The panel terminal unit D'2 includes the metal bus electrode pad 71 extending from the panel display unit D'1 on the front surface glass 61A, and a film-shaped device 74 which is connected to the metal bus electrode pad 71 and provides a driving signal controlled by a printed circuit board (PCB) (not shown). For example, the film-shaped device 74 can be a chip on flexible printed circuit (COF) or a tape carrier package (TCP.) The metal bus electrode pad 71 can be bonded to the film-shaped device 74 by an anisotropic conductive film (ACF) 76. The ACF 76 can be formed of a film in which conductive particles, such as a metal-coated epoxy or metal particles are dispersed. The ACF 76 electrically connects the metal bus electrode pad 71 electrically connected to the metal bus electrode 63 to the film-shaped device 14.

The upper dielectric layer 64 extends to contact the anisotropic conductive film 76 on the metal bus electrode pad 71 so that the upper dielectric layer 64 covers the metal bus electrode pad 71. An extension part 65 of the upper dielectric layer 64 contacts an end of the anisotropic conductive film 76, and also contacts an electrode terminal unit sealant 72 to seal a bus electrode terminal unit. Meanwhile, the electrode terminal unit sealant 72 is coated in the panel terminal unit D'2 of the plasma display panel, and more specifically, the electrode terminal unit sealant 72 is coated on a connection part between the metal bus electrode pad 71 and the film-shaped device 74. The electrode terminal unit sealant 72 is coated before the anisotropic conductive film 76 is pressure-deposited.

In the current embodiment, a connection part between an electrode unit and a circuit of the plasma display panel is covered by a dielectric layer, so that the electrode of the plasma display panel can be protected against permeation of external gas or external humidity. Accordingly, formation of a vertical line defect occurring when a discharge occurs in the plasma display panel due to open and short circuits can be prevented.

According to another embodiment, a plasma display panel includes a panel display unit D'1 which includes a plurality of address electrodes and a panel terminal unit D'2 which provides a driving signal to the address electrodes. The panel terminal unit includes an address electrode pad extending from the address electrodes of the panel display unit; an anisotropic conductive film electrically connecting the address electrode pad to a film-shaped device; a lower dielectric layer extending to contact the anisotropic conductive film on the address electrode pad so that the lower dielectric layer covers the address electrode pad; and an address electrode terminal unit sealant sealing the lower dielectric layer and the film-shaped device.

Figure 7:
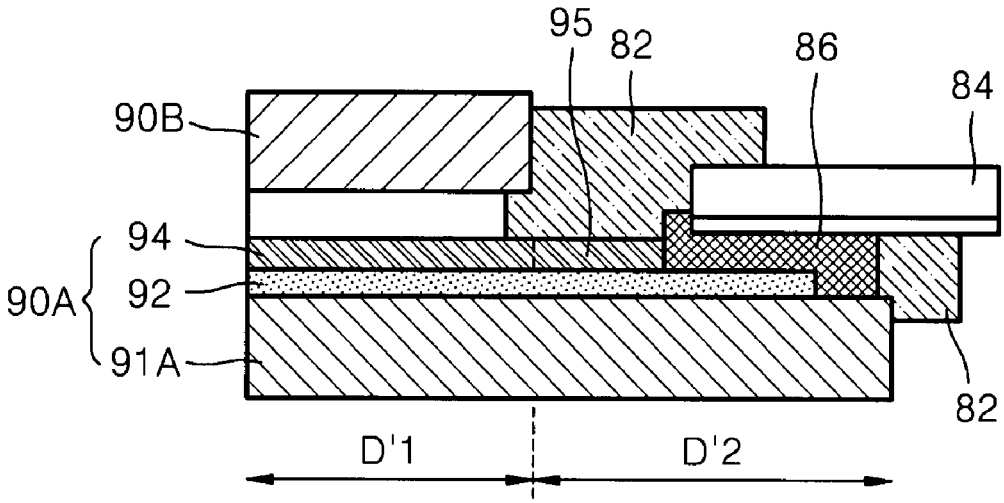
FIG. 7 is a sectional view of part of a plasma display panel according to another embodiment.

FIG. 7 is a sectional view of part of a plasma display panel according to another embodiment.

Referring to FIG. 7, a rear panel 90A includes an address electrode 92 disposed perpendicular to a scan electrode or a sustain electrode on a rear surface glass 91A, and a lower dielectric layer 94 covering the address electrode 92 on the rear surface glass 91A.

The front panel 90B includes a transparent electrode disposed perpendicular to the address electrode on a front surface glass (not shown), and an upper dielectric layer (not shown) covering the transparent electrode on the front surface glass (not shown.)

The panel terminal unit D'2 includes the address electrode 92 extending from the panel display unit D'1 on the rear surface glass 91A, and a film-shaped device 84 which is connected to the address electrode 92 and provides a driving signal controlled by a PCB (not shown). The film-shaped device 84 can be a chip on flexible printed circuit (COF) or a tape carrier package (TCP.) The address electrode 92 is bonded to the film-shaped device 84 by an anisotropic conductive film (ACF) 86. The ACF 86 can be formed of a film in which conductive particles, such as a metal-coated epoxy or metal particles, are dispersed. The ACF 86 electrically connects the address electrode 92 to the film-shaped device 84.

In the current embodiment, the lower dielectric layer 94 extends to contact the anisotropic conductive film 86 on the address electrode 92 so that the lower dielectric layer 94 covers the address electrode 92. An extension part 95 of the lower dielectric layer 94 contacts an end of the anisotropic conductive film 86, and also contacts an electrode terminal unit sealant 82 to seal an address electrode terminal unit. The electrode terminal unit sealant 82 is coated in the panel terminal unit D'2 of the plasma display panel, and the electrode terminal unit sealant 82 is coated on a connection part between the address electrode 92 and the film-shaped device 84. The electrode terminal unit sealant 82 is coated before the anisotropic conductive film 86 is deposited under pressure.

The present embodiments will be described in further detail with reference to the following examples. These examples are for illustrative purposes only and are not intended to limit the scope of the present embodiments.

EXAMPLE 1

An electrode pad is formed extending from an electrode, a film-shaped device is disposed to provide a driving signal to the electrode pad, and the electrode pad and the film-shaped device are electrically connected by an anisotropic conductive film. The electrode pad is covered by an upper dielectric layer, and the upper dielectric layer is extended to contact the anisotropic conductive film. An electrode part of the electrode pad is not directly exposed to the outside and does not directly contact an electrode terminal unit sealant.

The electrode terminal unit sealant which seals the upper dielectric layer and the film-shaped device is coated to a thickness of 0.5 μm before the anisotropic conductive film is pressure-deposited, thereby completing a plasma display panel.

COMPARATIVE EXAMPLE 1

A plasma display panel is manufactured in the same manner as in Example 1 except that a regular panel is used.

COMPARATIVE EXAMPLE 2

A plasma display panel is manufactured in the same manner as in Example 1 except that the sealant used is [SL 9189L-SP (added with sulfur-capturing material-triazole group)] produced by Dow Corning Co. (Midland, Mich.).

COMPARATIVE EXAMPLE 3

A plasma display panel is manufactured in the same manner as in Example 1 except that the sealant used is TF-4200EB-451, produced by Hitachi Chemical Co. (Beijing, China).

COMPARATIVE EXAMPLE 4

A plasma display panel is manufactured in the same manner as in Embodiment 1 except that a sealants used, KE-44 and KE-45 are produced by Shinetsu Co. (Tokyo, Japan).

Performance Test

Sulfur Erosion-Resistant Properties

Sulfur erosion-resistant properties of the plasma display panels manufactured according to Example 1 and Comparative Examples 1-4 were measured. The performance test was performed for more than 240 hours to detect whether an open circuit occurred and the time at which any open circuit occurred. The results are shown in Table 1. In Table 1, '○' denotes that the open circuit did not occur and that an image was displayed well, and 'x' denotes that an open circuit did occur and a vertical line was formed during a discharge.

TABLE 1

| Test Sample | Material Manufacturer | Process Time 20 hours | 60 hours | 100 hours | 240 hours | |
|---|---|---|---|---|---|---|
| Example 1 | — | ○ | ○ | ○ | ○ | — |
| Comparative Example 1 | Regular Panel | x | — | — | — | After 6 hours |
| Comparative Example 2 | Sealant produced by Dow Corning Co. | ○ | ○ | x | — | After 72 hours |
| Comparative Example 3 | Sealant produced by Hidachi Chemical Co. | ○ | ○ | x | — | After 90 hours |
| Comparative Example 4 | Silicon Sealant produced by Shinetsu Co. | ○ | x | — | — | After 20 hours |

Referring to Table 1, an open circuit did not occur in the plasma display panel manufactured according to Example 1 after 240 hours; on the other hand, an open circuit did occur in the plasma display panels manufactured according to Comparative Examples 1-4 after 6, 72, 90, and 20 hours, respectively.

Thus, it was determined that when the upper dielectric layer is extended to contact the anisotropic conductive film and covers the electrode pad, the sulfur erosion resistance is better than when other sealants are used, so that an open circuit can be prevented.

High Temperature/High Humidity Reliability Test

Figure 8:
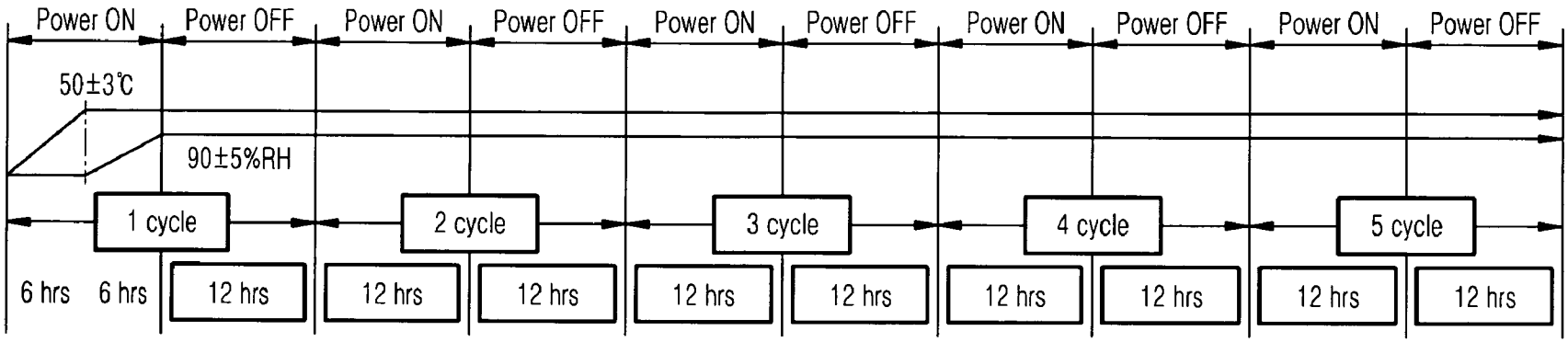
FIG. 8 is a schematic flow chart illustrating conditions for high temperature/high humidity reliability tests performed to measure properties of an electrode terminal unit sealant, according to another embodiment.

High temperature/high humidity reliability tests were performed under conditions illustrated in FIG. 8, using samples manufactured according to Comparative Example 1 in which a regular panel was used, Comparative Example 2 in which the sealant produced by Dow Corning Co. was used, Comparative Example 3 in which the sealant produced by Hitachi Chemical Co., Comparative Embodiment 4 in which the silicon sealant produced by Shinetsu Co. was used, and Example 1 in which an upper dielectric layer was extended. Five samples were used for each case and the number of samples having defects was measured while increasing the number of operating cycles. The results are shown in Table 2.

TABLE 2

| Number of Samples | | Test Results (Accumulated Data) 1 cycle | 2 cycles | 3 cycles | 4 cycles | 5 cycles | Sample |
|---|---|---|---|---|---|---|---|
| 42HD V4 | 5 | 0 | 0 | 0 | 2 | 4 | Comparative Example 1 |
| | 5 | 0 | 0 | 0 | 0 | 2 | Comparative Example 2 |
| | 5 | 0 | 0 | 0 | 2 | 3 | Comparative Example 3 |
| | 5 | 0 | 0 | 0 | 1 | 3 | Comparative Example 4 |
| | 5 | 0 | 0 | 0 | 0 | 1 | Example 1 |

As shown in Table 2, even when the number of cycles was increased, only one in five plasma display panels according to the present embodiments using an electrode terminal unit sealant had a defect. However, in the case of the plasma display panels manufactured according to Comparative Examples 1-4 the number of defects increased as the number of cycle increased, even though the plasma display panels had no defects during the first cycle.

According to the present embodiments, a dielectric layer is extended to a connection part between an electrode unit and circuit of a plasma display panel, so that a terminal unit can be protected against permeation of external gas or external humidity and open and short circuits of electrodes due to a migration phenomenon can be effectively prevented.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising a panel display unit comprising a plurality of electrodes and a panel terminal unit configured to provide a driving signal to the electrodes, wherein the panel terminal unit comprises:

an electrode pad extending from the electrodes of the panel display unit;

a film-shaped device providing a driving signal to the electrode pad;

an anisotropic conductive film electrically connecting the electrode pad to the film-shaped device;

a dielectric layer extending to contact the anisotropic conductive film on the electrode pad so that the dielectric layer covers the electrode pad; and an electrode terminal unit sealant sealing the dielectric layer and the film-shaped device;

wherein the electrode terminal unit sealant comprises a migration-resistant compound that contains a triazole group.

2. The plasma display panel of claim 1, wherein the dielectric layer is formed of a material that does not contain lead.

3. The plasma display panel of claim 1, wherein the dielectric layer is formed of ZnO or $Bi_2O_3$.

4. The plasma display panel of claim 1, wherein an end of the dielectric layer contacts an end of the anisotropic conductive film.

5. The plasma display panel of claim 1, wherein the electrodes are discharge electrodes.

6. A plasma display panel comprising a panel display unit comprising a plurality of bus electrodes and a panel terminal unit providing a driving signal to the bus electrodes, wherein the panel terminal unit comprises:

a bus electrode pad extending from the bus electrodes of the panel display unit;

a film-shaped device configured to provide a driving signal to the bus electrode pad;

an anisotropic conductive film electrically connecting the bus electrode pad to the film-shaped device;

an upper dielectric layer extending to contact the anisotropic conductive film on the bus electrode pad so that the upper dielectric layer covers the bus electrode pad; and a bus electrode terminal unit sealant sealing the upper dielectric layer and the film-shaped device;

wherein the electrode terminal unit sealant comprises a migration-resistant compound that contains a triazole group.

7. The plasma display panel of claim 6, wherein the upper dielectric layer is formed of a material that does not contain lead.

8. The plasma display panel of claim 6, wherein the upper dielectric layer is formed of ZnO or $Bi_2O_3$.

9. The plasma display panel of claim 6, wherein an end of the upper dielectric layer contacts an end of the anisotropic conductive film.

10. A plasma display panel comprising a panel display unit comprising a plurality of address electrodes and a panel terminal unit configured to provide a driving signal to the address electrodes, wherein the panel terminal unit comprises:

an address electrode pad extending from the address electrodes of the panel display unit;

a film-shaped device configured to provide a driving signal to the address electrode pad;

an anisotropic conductive film electrically connecting the address electrode pad to the film-shaped device;

a lower dielectric layer extending to contact the anisotropic conductive film on the address electrode pad so that the lower dielectric layer covers the address electrode pad; and an address electrode terminal unit sealant sealing the lower dielectric layer and the film-shaped device;

wherein the electrode terminal unit sealant comprises a migration-resistant compound that contains a triazole group.

11. The plasma display panel of claim 10, wherein the lower dielectric layer is formed of a material that does not contain lead.

12. The plasma display panel of claim 10, wherein the lower dielectric layer is formed of ZnO or $Bi_2O_3$.

13. The plasma display panel of claim 10, wherein an end of the lower dielectric layer contacts an end of the anisotropic conductive film.

* * * * *